United States Patent [19]

Sumerau et al.

[11] Patent Number: 4,670,937

[45] Date of Patent: Jun. 9, 1987

[54] FILTER RETENTION SYSTEM FOR VACUUM CLEANERS

[75] Inventors: William R. Sumerau, Easley; Henry C. Harbin, Anderson, both of S.C.

[73] Assignee: The Singer Company, Stamford, Conn.

[21] Appl. No.: 868,503

[22] Filed: May 30, 1986

[51] Int. Cl.[4] ..... A47L 9/14; A47L 9/32

[52] U.S. Cl. ..... 15/329; 15/347; 15/352; 15/410; 55/378

[58] Field of Search ..... 15/329, 347, 352, 410; 55/378

[56] References Cited

U.S. PATENT DOCUMENTS

| | | | |
|---|---|---|---|
| 2,390,196 | 12/1945 | Taylor | 55/378 X |
| 2,784,800 | 3/1957 | Segesman | 55/378 X |
| 3,758,914 | 9/1973 | Nupp et al. | 15/329 |
| 4,452,618 | 6/1984 | Kuplas | 55/378 X |

FOREIGN PATENT DOCUMENTS

| | | | |
|---|---|---|---|
| 398849 | 7/1924 | Fed. Rep. of Germany | 15/410 |
| 3435878 | 4/1986 | Fed. Rep. of Germany | 15/410 |
| 1066808 | 1/1954 | France | 15/410 |

*Primary Examiner*—Chris K. Moore
*Attorney, Agent, or Firm*—David L. Davis

[57] ABSTRACT

An arrangement in a vacuum cleaner preventing dirt collecting bag spill during a vacuuming operation by the combination of a bag retaining interlock with a cleaner handle shiftable between extreme positions each suitable for a different cleaner operating mode, with interlock release provided only in an intermediate, unuseable handle position.

12 Claims, 8 Drawing Figures

FILTER RETENTION SYSTEM FOR VACUUM CLEANERS

BACKGROUND OF THE INVENTION

1. Field of the Invention

This invention relates to vacuum cleaners of the type employing a dirt filter and, more particularly, to a convenient and cost effective means for selectively locking a dirt filter in effective dirt collecting relation within a vacuum cleaning apparatus or rendering the dirt filter separable from the vacuum cleaner for disposal and replacement.

2. Description of the Prior Art

It is well known in the vacuum cleaner art to provide latches devoted specifically to the retention of dirt filter retaining means on the cleaner body as disclosed, for instance, in U.S. Pat. No. 1,558,006 of Fisker, Oct. 20, 1925.

U.S. Pat. No. 3,323,675 of Van Der Ham et al, June 6, 1967, discloses a cannister vacuum cleaner in which a dirt filter retaining latch is provided which can be snapped open by shifting the carrying handle of the cleaner into an extreme position.

Numerous disclosures exist in the prior art of vacuum cleaners which, in addition to locking devices devoted specifically to retention of dirt filters in the cleaner body, also provide a shiftable handle which in certain useable positions of the handle interfere with complete removal of the dirt filter from the cleaner as shown, for example, in U.S. Pat. No. 2,390,196 of Taylor, Dec. 4, 1945 or U.S. Pat. No. 3,758,914 of Nupp et al, Sept. 18, 1973. The specifically devoted dirt filter retaining latch devices of the prior art are an expense reducing the cost effectiveness of the cleaners. The disclosures of handle constructions which in certain useable positions interfere with complete dirt filter removal do not prevent partial displacement of the dirt filters and, thus, do not prevent spilling of collected dirt.

SUMMARY OF THE INVENTION

It is an object of this invention to provide a vacuum cleaner in which the parts, for instance the cleaner body and a handle, may be selectively rearranged into either an extended position relatively to each other rendering the cleaner useable for floor cleaning operation or in retracted position relatively to each other rendering the cleaner useable for portable hand carried cleaning operations. A locking device for retaining the dirt filter in operative relation in the cleaner is associated with the supporting structure sustaining the handle relatively to the cleaner body and is arranged to maintain the dirt filter securely locked in operative relation in the cleaner while the handle occupies either extended or retracted useable positions. Only in a predetermined unuseable position of the handle intermediate the two useable positions does the locking device occupy an ineffective position releasing the dirt filter lock and permitting removal and replacement of the dirt filter. As a result, accidental or inadvertent release of the dirt filter locking device is not possible while the cleaner handle occupies any useable postion; thus, accidental spilling of dirt by unintentional release of the dirt filter during use of the cleaner is obviated.

DESCRIPTION OF THE DRAWINGS

The above and additional objects and advantages of this invention will be apparent from the following description taken in conjunction with the accompanying drawings of a preferred embodiment in which.

DETAILED DESCRIPTION OF THE INVENTION

Figure 1:
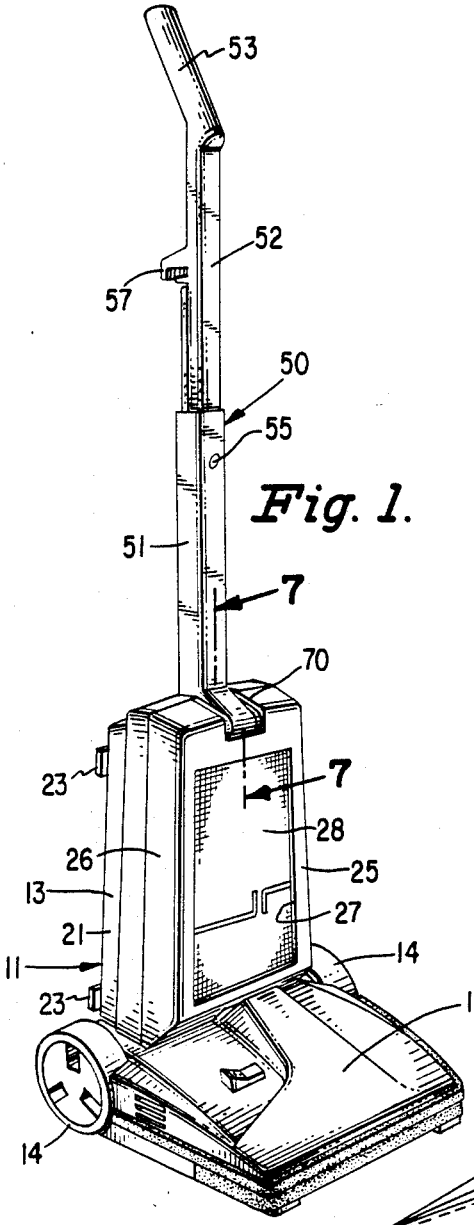
FIG. 1 is a perspective view of a vacuum cleaner having this invention applied thereto and showing the handle in one extreme position for floor cleaning operation and with the dirt filter locked in effective dirt collecting relation therein.
Figure 3:
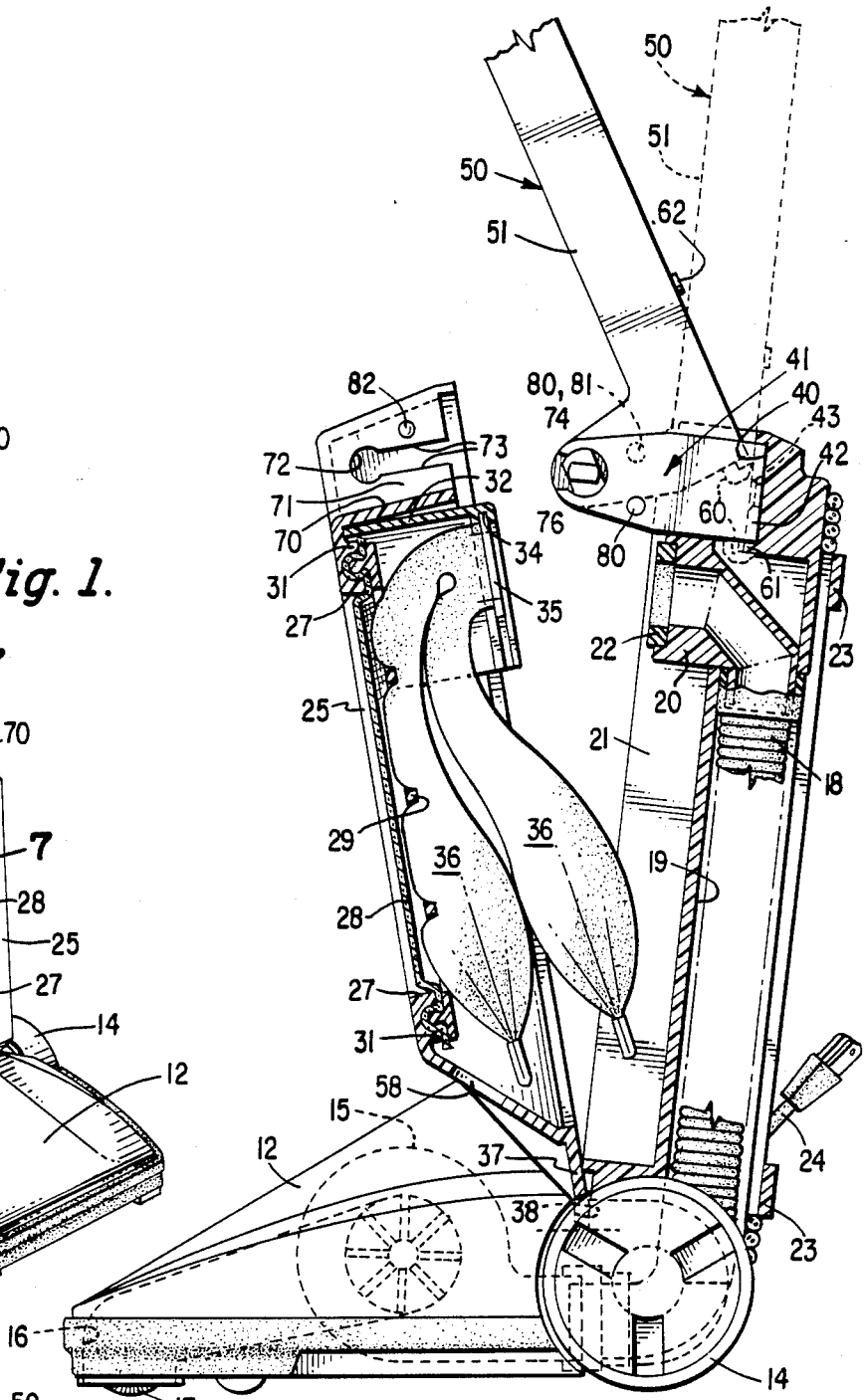
FIG. 3 is an enlarged elevational view partly in section of portions of the vacuum cleaner of FIG. 1 with the handle arranged in a position unuseable for vacuum cleaning operation and with the dirt filter locking means ineffective so as to provide for removal and replacement of the dirt filter.
Figure 2:
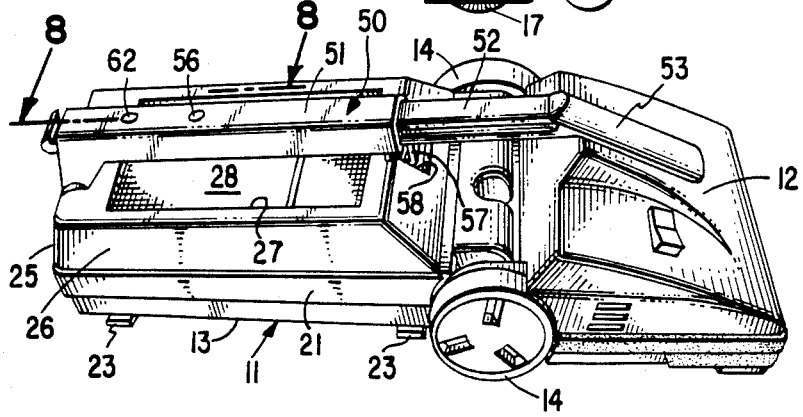
FIG. 2 is a perspective view of the vacuum cleaner of FIG. 1 showing the handle in another extreme position for hand carried vacuum cleaning operation.
Figure 5:
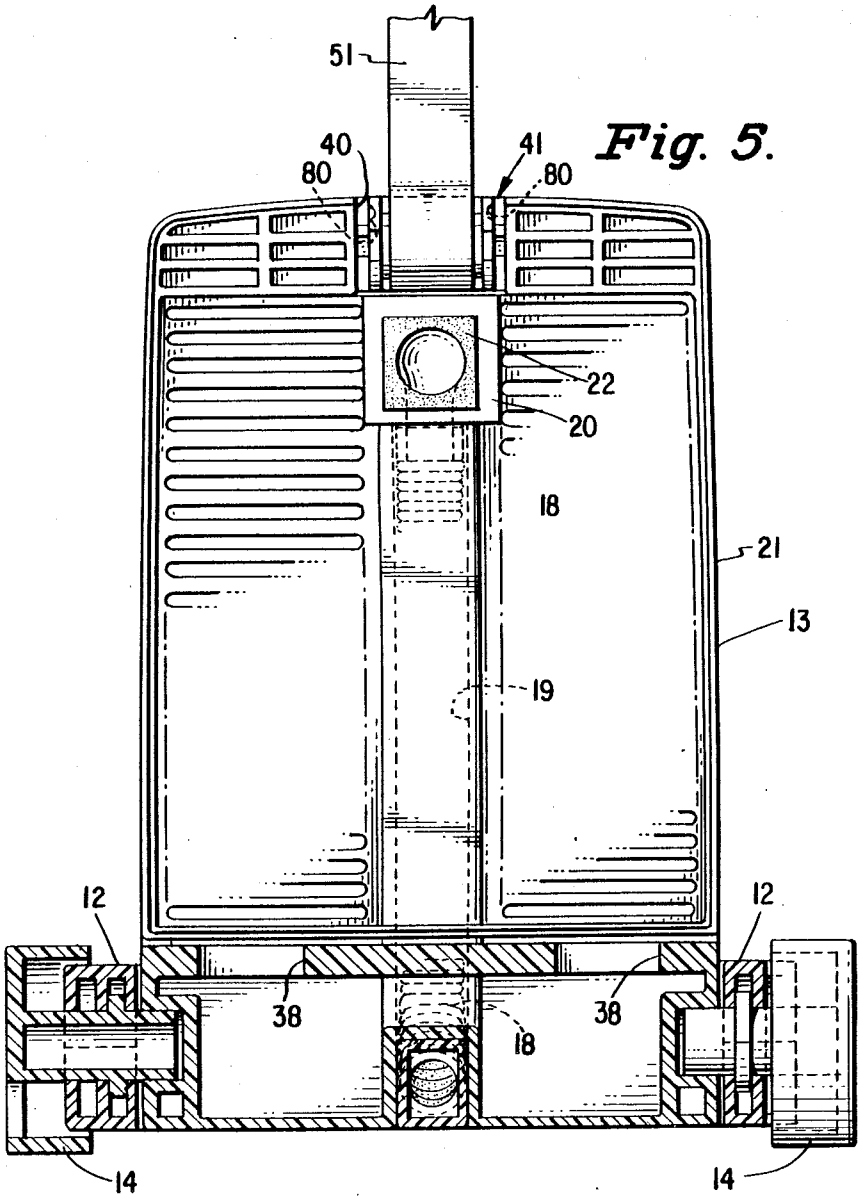
FIG. 5 is an elevational view showing the inside of the dirt filter accommodating body portion of the vacuum cleaner of FIGS. 1 and 2.

Referring particularly to FIGS. 1, 2, and 3 of the drawings, this invention is illustrated as applied to a vacuum cleaner indicated generally at 11 and comprising a head portion 12 pivotally connected to a body portion 13. Wheels 14 may be rotationally supported on or adjacent the pivotal connection between the head and body portions. A motor blower 15 is arranged in the head portion together with a nozzle 16 which may be fitted with a driven brush 17. A flexible tube 18 extends from the motor blower 15 in the head portion 12 along a trough 19 formed in the rear of the body portion 13 to an exhaust fitting 20 providing a terminus to the air conduit from the vacuum cleaner nozzle 16, said terminus being arranged between the side walls 21 and facing the open front of the vacuum cleaner body portion 13. The exhaust fitting is preferably fitted with a flexible gasket 22. Retaining fingers 23 extending from the rear of the vacuum cleaner body portion 13 provide storage for coils of the power cord 24 for the motor blower.

Figure 7:
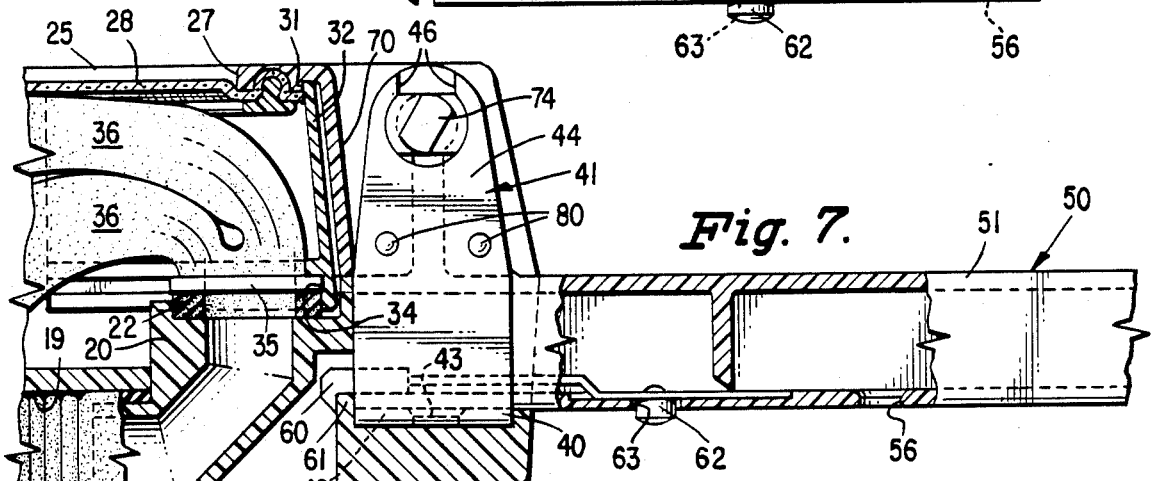
FIG. 7 is an enlarged cross sectional view taken substantially along line 7—7 of FIG. 1 illustrating the dirt filter locking device in effective position with the handle occupying extended position for floor supported operation of the vacuum cleaner.
Figure 8:
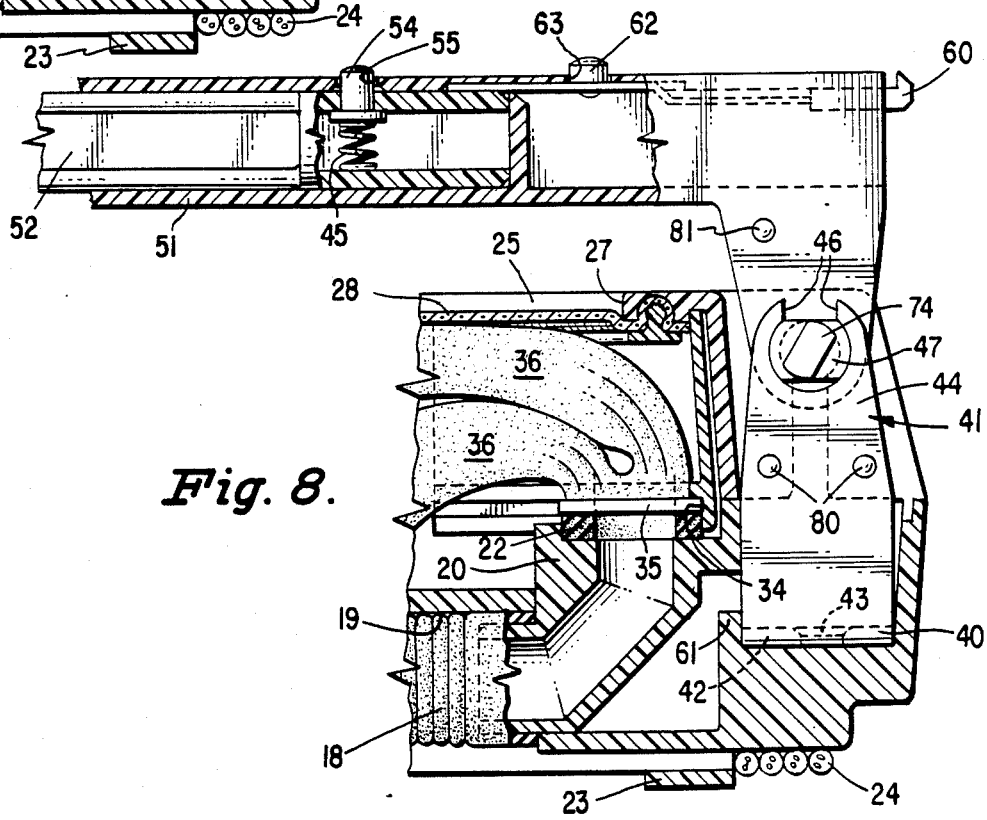
FIG. 8 is an enlarged cross sectional view taken substantially along line 8—8 of FIG. 2, illustrating the dirt filter locking device in effective position with the handle occupying retracted position for hand carried operation of the vacuum cleaner.

The open front of the vacuum cleaner body portion 13 is adapted to be closed by a cover 25 having the form of a shallow tray with side walls 26 aligned and interfitting the sidewalls 21 of the body portion 13 of the vacuum cleaner when the cover is in place thereon. As shown in FIGS. 3, 7, and 8, the cover 25 is preferably formed with a large central opening 27 covered by a layer of porous material 28 retained in place by a grille member 29 formed with a peripheral lip 30 which cooperates with a retaining projection 31 extending around the central opening 27 of the cover to clamp the porous material in place. The porous material covering the opening provides for the egress of air from the cleaner body when the cover 25 is in place.

Figure 4:
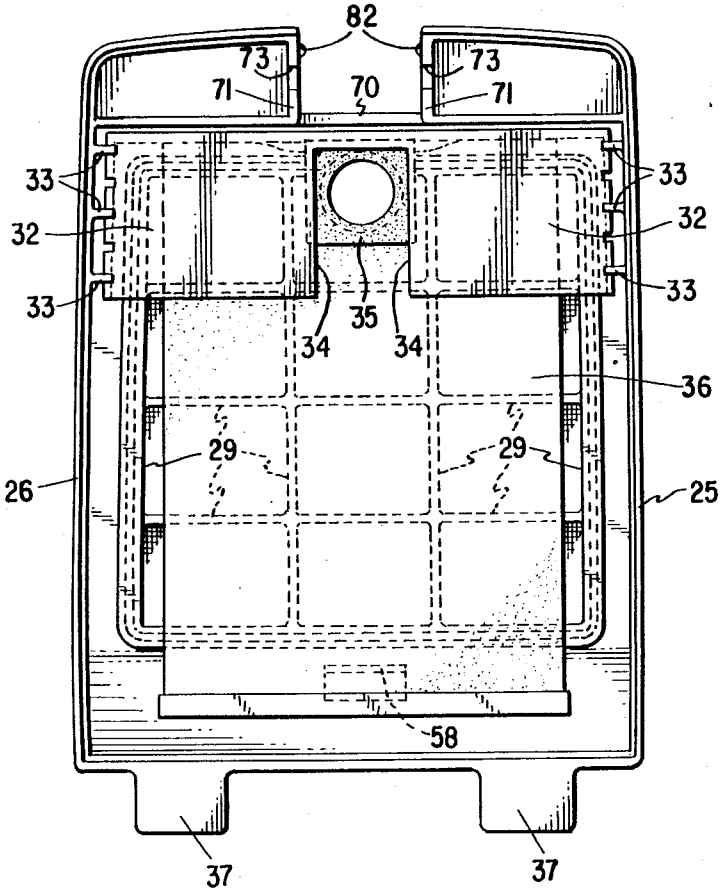
FIG. 4 is an elevational view showing the inside of the dirt filter accommodating tray of the vacuum cleaner of FIGS. 1 and 2.

As best shown in FIG. 4, a retaining member 32 for the disposable dirt bag is accommodated inside the cover 25 and secured therein as by being forced in place between a plurality of locking ribs 33 inwardly extending from each of the cover sidewalls 26. The bag retaining member 32 is formed with a slotted recess 34 shaped frictionally to accommodate and locate a collar portion 35 of a disposable dirt collecting bag 36. The tray-like cover thus serves as a holder for a dirt collecting bag and is formed with projections 37—37 which are accommodated in sockets 38—38 formed in the vacuum cleaner body portion adjacent the pivotal connection thereof with the head portion of the cleaner. The projections and sockets 37 and 38 provide for pivotal support of the cover in movement toward and away from position closing the open front of the cleaner body portion. The slotted recess 34 of the dirt bag retainer 32 is formed, as shown in FIGS. 3, 7, and 8 to hold the collar portion 35 of the dirt collecting bag in registry with the exhaust fitting 20 when the projections 37—37 are seated in the sockets 38—38.

The free extremity of the cleaner body portion 13 is formed with a recess 40 adapted to accommodate means for supporting a handle indicated generally at 50 on the vacuum cleaner. Preferably, the handle is supported on the cleaner body by a U-shaped bracket 41 having a base 42 secured to the cleaner body by any suitable means, such as a staking 43, or use of a rivet or other fastening device. Each free arm 44 of the U-shaped bracket 41 is formed with a circularly shaped aperture 45 which, as best shown in FIG. 6, is joined by a slot 46 narrower than the diameter of the circularly shaped aperture and extending radially from the aperture to the extremity of the bracket arm 44.

The handle 50 for pivotal support on the bracket arm 44 is formed at each side with a bearing projection 47. Each of the bearing projections, as shown in FIG. 6, is formed circumferentially with circularly shaped segments 48—48 having radii substantially equal to that of the circularly shaped apertures 45 in each bracket arm 44 and with parallel slabbed surfaces 49—49 spaced apart a distance substantially equal to the width of the bracket arm slot 46. When the slabbed surfaces 49—49 are aligned with the slots 46, as illustrated in FIG. 6, the bearing projections 47 may be shifted into the circularly shaped apertures 45 which provide bearing holes for the bearing projections 47—47 and then the handle may be pivoted about the pivotal axis defined by the center of the bearing holes 45. Whether the bearing projections are formed integrally with the handles, as shown in the preferred embodiment, or formed as a separate shaft or axle member, a discrete position of the bearing projections, referred to herein as the first discrete position relatively to the vacuum cleaner body portion, is required for insertion of the bearing projections into the slots 46. Furthermore, after the slightest turning movement of the handle after the bearing projections are positioned in the circular apertures 45, the handle will be constrained on the bracket 41 until the handle is again positioned so as to align the slabbed surfaces 49—49 with the slots 46.

Figure 6:
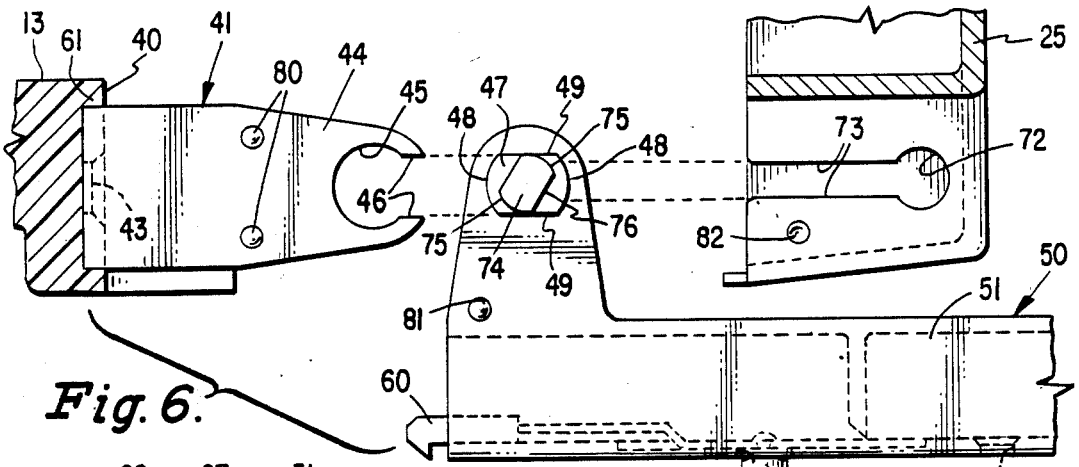
FIG. 6 is an exploded view of a portion of the handle, the pivotal support bracket for the handle on the upper extremity of the body portion of the vacuum cleaner, and a fragment of the dirt filter accommodating tray showing the parts in position for assembly of the handle into pivotal relation with the bracket on the body portion of the cleaner.

FIGS. 3, 6 and 7 illustrate a latch device effective to constrain the handle in one extreme position relatively to the cleaner body portion 13 which is an extended position illustrated in FIG. 1 rendering the cleaner suitable for upright floor supported vacuum cleaning operation. This latch device comprises a flexible latch element 60 secured inside the handle 50 arranged protruding from the handle 50 and adapted, as illustrated in FIG. 3, to engage beneath a shoulder 61 on the cleaner body portion to retain the handle in the position shown in FIG. 1 and in dotted lines in FIG. 3. A release button 62 carried by the latch element 60 within the handle 50 is accessible to an operator through an aperture 63 in the handle permitting the latch element 60 to be shifted out of engagement beneath the shoulder 61 freeing the handle for pivotal movement out of the extended position.

Preferably, the handle 50 is formed with two telescopically and rotationally interrelated parts 51 and 52, part 51 being that formed with the bearing projections 47 and carrying the latch element 60. The part 52, which is formed at one extremity with a hand grip 53, is slidable lengthwise within the handle part 51 and at the extremity opposite the hand grip carries a spring loaded latch button 54 (see FIG. 8) which is engageable with either a latch aperture 55 near the free extremity of the handle portion 51 to lock the handle parts in extended position, or with a latch aperture 56 near the pivotal extremity of the handle portion 51 to lock the handle parts in retracted position depending upon the relative rotational position of the handle parts. In the retracted position of the handle parts, as shown in FIG. 2, a projection 57 on handle part 52 seats in a socket 58 in the cover 25 to constrain the handle in position for supporting the cleaner in a hand carried vacuum cleaning operation.

The interlock will now be described which is provided by this invention for preventing inadvertent spilling of collected dirt from the dirt collecting bag 36 during operation of the cleaner in any of the useable operating modes of the cleaner.

The tray-like cover 25 in which the dirt collecting bag 36 is held is formed with a handle accommodating recess 70 with side wall partitions 71—71 dimensioned to straddle the bearing projections 47—47 of the handle as well as the bracket arms 44 of the bracket 41 on the cleaner body portion. As best shown in FIGS. 3 and 6, each of the recess partitions 71—71 on the cover 25 is formed with a circularly shaped aperture 72 which is joined by a slot 73 narrower than the diameter of the circularly shaped aperture and extending radially from the aperture 72 to the free edge of the cover 25.

The handle is formed with a pair of locking studs 74—74, one extending outwardly from each of the bearing projections 47. The studs 74—74 serve as interlock members having a discrete position relatively to the vacuum cleaner body portion permitting movement of the dirt collecting bag holder into and out of dirt collecting position. Each of the studs 74, as best shown in FIG. 6, is formed circumferentially with circularly shaped segments 75—75 having radii substantially equal to that of the circularly shaped apertures 72 in each of the cover partitions 71—71. The studs are also each formed with parallel slabbed surfaces 76—76 spaced apart a distance substantially equal to the width of the partition slots 73.

Only when the slabbed surfaces 76—76 of the studs 74—74 are aligned with the slots 73 in the cover partitions 71, as shown in FIG. 3, can the cover 25 be shifted toward the cleaner body portion 13 to position the collar 35 of the dirt collecting bag against the resilient gasket 22 on the air conduit exhaust fitting 20. Similarly, the cover and dirt collecting bag can only be retracted to disconnect the dirt collecting bag from the exhaust fitting 20 in the handle position illustrated in FIG. 3. This handle position permitting removal and replacement of the dirt collecting bag is a position intermediate the extended and retracted extreme positions of the handle illustrated in FIGS. 1 and 2 and FIGS. 7 and 8, respectively, and this intermediate handle postion shown in FIG. 3 is a handle postion which is unuseable for any practical type of vacuum cleaning operation. Whether the studs 74—74, and the bearing projections 47 from which the studs project, are formed integrally with the handle, as shown in the preferred embodiment, or formed as a separate shaft or axle member, a discrete position of the studs, referred to herein as the second discrete position, is required for alignment with the slots 73 to permit movement of the dirt collecting bag holding cover. If the studs 74 and bearing projections 47 are not formed integrally with the handle, operative connections such as gearing or linkage will be required therebetween to corelate handle and interlock postions as when the parts are integrally formed.

Apertures 80 formed through the bracket arms 44 and cooperating resilient projections 81 on the handle are arranged so as to coincide in the intermediate position of the handle shown in FIG. 3 providing a first detent means imposing a light locating force on the handle in the position in which dirt collecting bag removal and replacement is possible so as to identify for an operator this critical handle position.

Resilient projections 82 on the cover partitions 71 are arranged to coincide with the bracket arm apertures 80 at the opposite sides of the bracket arms 44 from the handle projections 81 to provide a second detent means imposing a light force retaining the cover 25 and dirt collecting bag collar against the resilient gasket. The retaining force provided by the cover partition projections 82—82 seating in the bracket arm apertures 80 is preferably slightly greater than the force exerted by the resilient gasket tending to repel the dirt collecting bag collar and, therefore, when the handle 50 traverses the intermediate position shown in FIG. 3 enroute to either extended or retracted handle positions, the cover will not spring open inadvertently because of the gasket pressure, but only if an intentional additional force is applied by the operator to remove the cover and bag.

Two apertures 80 are illustrated in the bracket arms 44 so that the bracket 41 may be secured to the cleaner body portion in either orientation.

With reference to FIG. 2, it will be noted that the presence of the cover 25 and the socket 58 thereon is necessary for the handle 50 to be locked by the projections 57 into retracted position for hand carried vacuum cleaning operation.

As illustrated in FIGS. 3 and 8, the cover can occupy the position shown in FIGS. 2 and 8 only if the interlock between the studs 74 and the cover partition apertures 72 is effective. If the studs 74 do not enter the partition slots 73, as shown in FIG. 3, movement of the handle 50 toward retracted position will be blocked by the cover 25. If the studs 74 do not occupy positions completely within the circular apertures 75 of the partitions, all movement of the handle 50 out of the intermediate position shown in FIG. 3 will be prevented. These interrelationships make it clear, therefore, that it is the interlock between the apertures 72 and the studs 74 which prevent dirt collecting bag release in this invention and not any blocking postion of the handle in the path of dirt collecting bag egress.

We claim:

1. A vacuum cleaner having a body portion, a vacuum cleaner manipulating handle, means shiftably supporting said handle relatively to said vacuum cleaner body portion for movement between two extreme positions each defining a different operating mode for said vacuum cleaner;

a dirt collecting bag holder;

means for accommodating movement of said dirt collecting bag holder relatively to said vacuum cleaner body portion into and out of a location sustaining a dirt collecting bag held thereby in a dirt collecting position relative to said vacuum cleaner;

an interlock between said vacuum cleaner body portion and said dirt collecting bag holder including an interlock member shiftably supported relatively to said vacuum cleaner body portion, said interlock member having a discrete position relatively to said vacuum cleaner body portion permitting movement of said dirt collecting bag holder into and out of said dirt collecting position; and means responsive to movement of said handle into a specific position intermediate said extreme positions for shifting said interlock member into said discrete position permitting dirt collecting bag holder movement.

2. A vacuum cleaner as set forth in claim 1 including detent means arranged between said dirt collecting bag holder and said vacuum cleaner body portion, said detent means being effective to apply a light force resisting movement of said dirt collecting bag holder out of said location sustaining a dirt collecting bag held thereby in a dirt collecting position when said interlock occupies said ineffective position.

3. A vacuum cleaner as set forth in claim 1 including detent means arranged between said handle and said vacuum cleaner body portion, said detent means being effective to apply a light force identifying and restraining said handle in said specific position in which said interlock occupies said discrete position.

4. A vacuum cleaner as set forth in claim 1 including a first detent means arranged between said handle and said vacuum cleaner body portion, said first detent means being effective to apply a light force identifying and restraining said handle in said specific position in which said interlock occupies said discrete position, and including a second detent means arranged between said dirt collecting bag holder and said vacuum cleaner body portion, said second detent means being effective to apply a light force resisting movement of said dirt collecting bag holder out of said location sustaining a dirt collecting bag held thereby in a dirt collecting position when said interlock occupies said discrete position.

5. A vacuum cleaner having a body portion, a vacuum cleaner manipulating handle, means shiftably supporting said handle relatively to said vacuum cleaner body portion for movement between two extreme positions each defining a different operating mode for said vacuum cleaner;

a dirt collecting bag holder;

means for accommodating movement of said dirt collecting bag holder relatively to said vacuum cleaner body portion into and out of a location sustaining a dirt collecting bag held thereby in a dirt collecting position relative to said vacuum cleaner;

interlock means between said vacuum cleaner body portion and said dirt collecting bag holder including an interlock member;

cooperating shiftable support means for said interlock member and on said vacuum cleaner body portion accommodating insertion and removal of said interlock member thereon in a first discrete position of said interlock member with respect to said vacuum cleaner body portion;

said interlock member having a second discrete position with respect to said vacuum cleaner body portion permitting movement of said dirt collecting bag holder into and out of said dirt collecting position; and means responsive to said movement of said handle for shifting said interlock member into said first and said second discrete positions when said handle occupies two different specific positions relatively to said vacuum cleaner body portion, each of said specific positions being intermediate said extreme positions.

6. A vacuum cleaner having a body portion, a vacuum cleaner manipulating handle, means shiftably supporting said handle relatively to said vacuum cleaner body portion for movement between two extreme positions each defining a different operating mode for said vacuum cleaner;

a dirt collecting bag holder;

means for accommodating movement of said dirt collecting bag holder relatively to said vacuum cleaner body portion into and out of a location sustaining a dirt collecting bag held thereby in a dirt collecting position relative to said vacuum cleaner; and an interlock between said handle and said dirt collecting bag holder, said interlock having an ineffective position permitting movement of said dirt collecting bag holder into and out of said dirt bag sustaining location when said handle occupies a specific position intermediate said extreme positions and an effective position preventing said dirt collecting bag holder movement in each of said extreme handle positions.

7. A vacuum cleaner as set forth in claim 6 including detent means arranged between said dirt collecting bag holder and said vacuum cleaner body portion, said detent means being effective to apply a light force resisting movement of said dirt collecting bag holder out of said location sustaining a dirt collecting bag held thereby in a dirt collecting position when said interlock occupies said ineffective position.

8. A vacuum cleaner as set forth in claim 6 including detent means arranged between said handle and said vacuum cleaner body portion, said detent means being effective to apply a light force identifying and restraining said handle in said specific position in which said interlock is ineffective.

9. A vacuum cleaner as set forth in claim 6 including a first detent means arranged between said handle and said vacuum cleaner body portion, said detent means being effective to apply a light force identifying and restraining said handle in said specific position in which said interlock is ineffective, and including a second detent means arranged between said dirt collecting bag holder and said vacuum cleaner body portion, said detent means being effective to apply a light force resisting movement of said dirt collecting bag holder out of said location sustaining a dirt collecting bag held thereby in a dirt collecting position when said interlock occupies said ineffective position.

10. A vacuum cleaner as set forth in claim 9 in which said means shiftably supporting said handle relatively to said vacuum cleaner body portion comprises a bracket arm carried by said vacuum cleaner body portion at one side of said handle, said handle having a lateral stud projecting therefrom through a bearing hole in said bracket arm, in which said dirt collecting bag holder includes a partition arranged at the opposite side of said bracket arm from said handle when said dirt collecting bag holder occupies a position sustaining a dirt collecting bag held thereby in a dirt collecting position relative to said vacuum cleaner, said bracket arm being formed with a through aperture providing an element of both said first and said second detent means, said handle carrying a detent projection cooperating with said bracket arm aperture at one side of said bracket arm to define said first detent means, and said dirt collecting bag holder partition carrying a detent projection cooperating with said bracket arm aperture at the opposite side of said bracket arm to define said second detent means.

11. A vacuum cleaner having a body portion;

a conduit having a terminus arranged in said vacuum cleaner body portion adapted to expel dirt laden air therein;

a tray having means for supporting the entrance mouth of a dirt collecting bag in predetermined position therein;

means for supporting said tray for movement in a substantially linear path relatively to said vacuum cleaner body portion to carry the entrance mouth of said dirt collecting bag into and out of communication with the terminus of said conduit;

a vacuum cleaner manipulating handle;

means supporting said handle on a pivotal axis in said vacuum cleaner body portion for handle movement between two extreme positions each defining a different operating mode for said vacuum cleaner; and interlock means on said handle and said tray for retaining said tray in a position in which the entrance mouth of a dirt collecting bag supported thereon will be sustained in communication with the terminus of said conduit;

said interlock means comprising a stud extending from said handle and encompassing the pivotal axis of the handle relatively to said vacuum cleaner body portion;

said stud being formed circumferentially with substantially flat parallel slabbed exterior surfaces one at each side of said axis and with circularly shaped segments extending between said slabbed surfaces;

said circularly shaped segments having equal radii extending from a center of curvature substantially coincident with said axis;

means defining a partition on said tray arranged opposite said handle stud and substantially perpendicular to the pivotal axis of said handle when said tray is influenced by said tray supporting means;

said partition being formed with a circular aperture having a radius equal to the radii of the circularly shaped segments of said handle stud and a narrow substantially straight slot having side walls spaced apart a distance equal to that between the parallel slabbed surfaces of said handle stud, said slot extending radially from said circular aperture to an edge of said partition; and said stud being arranged on said handle with said parallel slabbed surfaces aligned with said slot side walls when said handle occupies a position intermediate said two extreme positions.

12. A vacuum cleaner as set forth in claim 11 in which said means for supporting said handle on a pivotal axis in said vacuum cleaner includes a bearing projection extending from said handle adjacent to said stud;

said bearing projection being formed circumferentially with substantially flat parallel slabbed exterior surfaces one at each side of said axis and with circularly shaped segments extending between said slabbed surfaces;

said circularly shaped segments having equal radii extending from a center of curvature substantially coincident with said axis;

a bracket arm extending from said vacuum cleaner body portion at one side of said handle;

said bracket arm being formed with a circular aperture having a radius equal to the radii of the circularly shaped segments of said handle bearing projection and a narrow substantially straight slot having side walls spaced apart a distance equal to that between the parallel slabbed surfaces of said handle bearing projection, said slot extending radially from said circular aperture to an edge of said bracket arm; and said bearing projection being arranged on said handle with said parallel slabbed surfaces aligned with said slot side walls when said handle occupies a position intermediate said two extreme positions.

* * * * *